US010796860B2

(12) United States Patent
Iliev et al.

(10) Patent No.: US 10,796,860 B2
(45) Date of Patent: Oct. 6, 2020

(54) HERMETICALLY SEALED OVER-MOLDED BUTTON ASSEMBLY

(71) Applicant: N2 Imaging Systems, LLC, Irvine, CA (US)

(72) Inventors: Iliyan Iliev, Irvine, CA (US); Jay Meyer, Snohomish, WA (US)

(73) Assignee: N2 Imaging Systems, LLC, Irvine, CA (US)

( * ) Notice: Subject to any disclaimer, the term of this patent is extended or adjusted under 35 U.S.C. 154(b) by 21 days.

(21) Appl. No.: 16/217,557

(22) Filed: Dec. 12, 2018

(65) Prior Publication Data

US 2020/0194196 A1 Jun. 18, 2020

(51) Int. Cl.

| | |
|---|---|
| ***H01H 13/06*** | (2006.01) |
| ***H01H 13/14*** | (2006.01) |
| ***H01H 9/04*** | (2006.01) |

(52) U.S. Cl.

CPC ..... *H01H 13/063* (2013.01); *H01H 9/041* (2013.01); *H01H 13/14* (2013.01); *H01H 2013/066* (2013.01)

(58) Field of Classification Search

CPC .. H01H 13/06; H01H 2223/002; H01H 13/70; H01H 13/86; H01H 2223/003; H01H 9/04; H01H 23/06; H01H 13/063; H01H 2009/048

See application file for complete search history.

(56) References Cited

U.S. PATENT DOCUMENTS

| | | | |
|---|---|---|---|
| 2,452,592 | A | 11/1948 | Meyer |
| 2,627,659 | A | 2/1953 | Murr |
| 2,901,750 | A | 9/1959 | McMurry |
| 2,901,751 | A | 9/1959 | Gales et al. |
| 2,908,943 | A | 10/1959 | Miller |
| 3,320,619 | A | 5/1967 | Lastnik et al. |

(Continued)

FOREIGN PATENT DOCUMENTS

| | | |
|---|---|---|
| CN | 202057884 | 11/2011 |
| CN | 204730844 | 10/2015 |

(Continued)

OTHER PUBLICATIONS

Aebi, V. et al., "EBAPS: Next Generation, Low Power, Digital Night Vision", Presented at the OPTRO 2005 International Symposium, May 10, 2005, pp. 1-10, Paris, France, in 10 pages.

(Continued)

*Primary Examiner* — Ahmed M Saeed

(74) *Attorney, Agent, or Firm* — Knobbe, Martens, Olson & Bear, LLP

(57) ABSTRACT

A button assembly is disclosed including a plastic cover having an upper body portion and a lower flange portion, the upper body portion having a top wall and an interior cavity, wherein a port is formed in the top wall of the upper body portion and the lower flange portion is adapted and configured to be welded to a wall of a plastic housing, and an elastomeric button over-molded on the plastic cover and including an upper actuation portion and a lower body portion, wherein the upper actuation portion extends through the port formed in the top wall of the upper body portion of the cover, and the lower body portion resides in the interior cavity of the upper body portion of the cover.

10 Claims, 3 Drawing Sheets

(56) References Cited

U.S. PATENT DOCUMENTS 3,413,656 A 12/1968 Vogliano et al.
3,419,334 A 12/1968 Hubbard
3,594,062 A 7/1971 Disley
3,640,635 A 2/1972 Von Hollen
3,669,523 A 6/1972 Edwards
4,044,399 A 8/1977 Morton
4,183,646 A 1/1980 Tsunefuji
4,584,776 A 4/1986 Shepherd
4,601,540 A 7/1986 Karning et al.
4,605,281 A 8/1986 Hellewell
4,698,489 A 10/1987 Morley
4,758,719 A 7/1988 Sasaki et al.
4,786,966 A 11/1988 Hanson et al.
4,792,206 A 12/1988 Skuratovsky
4,840,451 A 6/1989 Sampson et al.
5,005,213 A 4/1991 Hanson et al.
5,035,472 A 7/1991 Hansen
5,125,394 A 6/1992 Chatenever et al.
5,128,807 A 7/1992 Blackmon
5,140,151 A 8/1992 Weiner et al.
5,303,606 A 4/1994 Kokinda
5,303,688 A 4/1994 Chiuminatta et al.
5,359,675 A 10/1994 Siwoff
5,448,161 A 9/1995 Byerley, III et al.
5,463,495 A 10/1995 Murg
5,513,440 A 5/1996 Murg
5,535,053 A 7/1996 Baril et al.
5,584,137 A 12/1996 Teetzel
5,651,081 A 7/1997 Blew et al.
5,653,034 A 8/1997 Bindon
5,668,904 A 9/1997 Sutherland et al.
5,687,271 A 11/1997 Rabinowitz
5,711,104 A 1/1998 Schmitz
5,847,753 A 12/1998 Gabello et al.
5,881,449 A 3/1999 Ghosh et al.
5,903,996 A 5/1999 Morley
5,946,132 A 8/1999 Phillips
5,949,565 A 9/1999 Ishida
5,953,761 A 9/1999 Jurga et al.
5,956,444 A 9/1999 Duda et al.
6,020,994 A 2/2000 Cook
6,057,966 A 5/2000 Carroll et al.
6,200,041 B1 3/2001 Gaio et al.
6,272,692 B1 8/2001 Abraham
6,311,576 B1 11/2001 Pletschet
6,327,381 B1 12/2001 Rogina et al.
6,369,941 B2 4/2002 Zadravec
6,381,081 B1 4/2002 Ford
6,404,961 B1 6/2002 Bonja et al.
6,456,497 B1 9/2002 Palmer
6,519,890 B1 2/2003 Otterman
6,560,029 B1 5/2003 Dobbie et al.
6,574,053 B1 6/2003 Spinali
6,615,531 B1 9/2003 Holmberg
6,690,866 B2 2/2004 Bonja et al.
6,714,708 B2 3/2004 McAlpine et al.
6,737,596 B1 * 5/2004 Hein ..... H01H 13/702 200/310
6,807,742 B2 10/2004 Schick et al.
6,898,192 B2 5/2005 Chheda et al.
6,901,221 B1 5/2005 Jiang et al.
7,016,579 B2 3/2006 Militaru et al.
7,062,796 B1 6/2006 Dixon
D524,785 S 7/2006 Huang
7,069,685 B2 7/2006 Houde-Walter
7,096,512 B2 8/2006 Blair
7,128,475 B2 10/2006 Kesler
7,132,648 B2 11/2006 Ratiff et al.
7,166,812 B2 1/2007 White et al.
7,171,776 B2 2/2007 Staley, III
7,194,012 B2 3/2007 Mason et al.
7,210,262 B2 5/2007 Florence et al.
7,210,392 B2 5/2007 Greene et al.
7,219,370 B1 5/2007 Teetzel et al.
7,278,734 B2 10/2007 Jannard et al.
7,292,262 B2 11/2007 Towery et al.
7,298,941 B2 11/2007 Palen et al.
7,319,557 B2 1/2008 Tai
7,369,302 B2 5/2008 Gaber
7,409,792 B2 8/2008 Narcy et al.
7,437,848 B2 10/2008 Chang
7,462,035 B2 12/2008 Lee et al.
7,488,294 B2 2/2009 Torch
7,552,559 B2 6/2009 Day
7,609,467 B2 10/2009 Blanding et al.
7,612,956 B2 11/2009 Blanding et al.
7,627,975 B1 12/2009 Hines
7,649,550 B2 1/2010 Ishiyama et al.
7,676,137 B2 3/2010 Schick et al.
7,690,849 B2 4/2010 Scharf et al.
7,701,493 B2 4/2010 Mauritzson
7,705,855 B2 4/2010 Brown Elliott
7,710,654 B2 5/2010 Ashkenazi et al.
7,730,820 B2 6/2010 Vice et al.
7,740,499 B1 6/2010 Willey et al.
7,744,286 B2 6/2010 Lu et al.
7,787,012 B2 8/2010 Scales et al.
7,795,574 B2 9/2010 Kennedy et al.
7,800,852 B2 9/2010 Blanding et al.
7,827,723 B1 11/2010 Zaderey et al.
7,832,023 B2 11/2010 Crisco
7,842,922 B2 11/2010 Leneke et al.
7,899,332 B2 3/2011 Shindou et al.
7,911,687 B2 3/2011 Scholz
7,916,156 B2 3/2011 Brown Elliott et al.
7,933,464 B2 4/2011 Zhang et al.
7,952,059 B2 5/2011 Vitale et al.
7,972,067 B2 7/2011 Haley et al.
7,990,523 B2 8/2011 Schlierbach et al.
8,014,679 B2 9/2011 Yamazaki
8,063,934 B2 11/2011 Donato
8,067,735 B2 11/2011 King et al.
8,082,688 B2 12/2011 Elpedes et al.
8,085,482 B2 12/2011 Frankovich et al.
8,093,992 B2 1/2012 Jancic et al.
8,112,185 B2 2/2012 Wu
8,153,975 B2 4/2012 Hollander et al.
8,225,542 B2 7/2012 Houde-Walter
8,253,105 B1 8/2012 Warnke et al.
8,312,667 B2 11/2012 Thomas et al.
8,336,776 B2 12/2012 Horvath et al.
8,337,036 B2 12/2012 Soto et al.
8,350,796 B2 1/2013 Tomizawa et al.
8,375,620 B2 2/2013 Staley, III
D677,298 S 3/2013 Hallgren
8,411,346 B2 4/2013 Sapir
8,488,969 B1 7/2013 Masarik
8,531,592 B2 9/2013 Teetzel et al.
8,532,490 B2 9/2013 Smith et al.
8,656,628 B2 2/2014 Jock et al.
8,717,392 B2 5/2014 Levola
8,773,766 B2 7/2014 Jannard et al.
8,776,422 B2 7/2014 Dodd et al.
8,781,273 B2 7/2014 Benjamin et al.
8,826,583 B2 9/2014 Kepler et al.
8,849,379 B2 9/2014 Abreu
8,886,046 B2 11/2014 Masarik
8,908,045 B2 12/2014 Stewart
8,923,703 B2 12/2014 Masarik
8,928,878 B2 1/2015 Jaeschke et al.
8,942,632 B2 1/2015 Shen
8,963,573 B2 2/2015 Achkir et al.
9,042,736 B2 5/2015 Masarik
9,052,153 B2 6/2015 Oh et al.
9,057,583 B2 6/2015 Matthews et al.
9,069,001 B2 6/2015 Braman et al.
9,093,231 B2 7/2015 Fujita et al.
9,113,061 B1 8/2015 Morley
9,225,419 B2 12/2015 Masarik
9,310,163 B2 4/2016 Bay
9,316,462 B2 4/2016 Varshneya
9,319,143 B2 4/2016 El-Ahmadi et al.
9,335,122 B2 5/2016 Choiniere
9,366,504 B2 6/2016 Hester et al.

(56) References Cited

U.S. PATENT DOCUMENTS

| | | | |
|---|---|---|---|
| 9,373,277 | B2 | 6/2016 | Sagan |
| 9,389,677 | B2 | 7/2016 | Hobby et al. |
| 9,429,391 | B2 | 8/2016 | Walker |
| 9,438,774 | B2 | 9/2016 | Masarik |
| 9,466,120 | B2 | 10/2016 | Maryfield et al. |
| 9,506,725 | B2 | 11/2016 | Maryfield et al. |
| 9,516,202 | B2 | 12/2016 | Masarik et al. |
| 9,593,913 | B1 | 3/2017 | Wright et al. |
| 9,615,004 | B2 | 4/2017 | Masarik |
| 9,622,529 | B2 | 4/2017 | Teetzel et al. |
| 9,658,423 | B2 | 5/2017 | Gustafson et al. |
| 9,696,111 | B2 | 7/2017 | Saadon |
| 9,705,605 | B2 | 7/2017 | Masarik |
| 9,769,902 | B1 | 9/2017 | Cain et al. |
| 9,823,043 | B2 | 11/2017 | Compton et al. |
| 9,861,263 | B2 | 1/2018 | Kwan et al. |
| 9,897,411 | B2 | 2/2018 | Compton et al. |
| 9,910,259 | B2 | 3/2018 | Armbruster et al. |
| 9,921,028 | B2 | 3/2018 | Compton et al. |
| 9,934,739 | B2 | 4/2018 | Hogan |
| 9,948,878 | B2 | 4/2018 | Simolon et al. |
| 9,995,901 | B2 | 6/2018 | Petersen |
| 10,003,756 | B2 | 6/2018 | Masarik et al. |
| 10,024,631 | B2 | 7/2018 | Portoghese et al. |
| 10,036,869 | B2 | 7/2018 | Fahr et al. |
| 10,095,089 | B2 | 10/2018 | Po et al. |
| 10,113,837 | B2 | 10/2018 | Masarik et al. |
| 10,190,848 | B2 | 1/2019 | VanBecelaere |
| 10,309,749 | B2 | 6/2019 | Hamilton |
| 10,379,135 | B2 | 8/2019 | Maryfield et al. |
| 10,584,941 | B2 | 3/2020 | Masarik et al. |
| 2002/0027690 | A1 | 3/2002 | Bartur et al. |
| 2004/0031184 | A1 | 2/2004 | Hope |
| 2005/0058444 | A1 | 3/2005 | Watanabe et al. |
| 2005/0114710 | A1 | 5/2005 | Cornell et al. |
| 2005/0225575 | A1 | 10/2005 | Brown Elliott et al. |
| 2005/0232512 | A1 | 10/2005 | Luk et al. |
| 2005/0254126 | A1 | 11/2005 | Lin et al. |
| 2005/0268519 | A1 | 12/2005 | Pikielny |
| 2006/0165413 | A1 | 7/2006 | Schemmann et al. |
| 2007/0003562 | A1 | 1/2007 | Druilhe |
| 2007/0035626 | A1 | 2/2007 | Randall et al. |
| 2007/0213586 | A1 | 9/2007 | Hirose et al. |
| 2007/0257944 | A1 | 11/2007 | Miller et al. |
| 2008/0263752 | A1 | 10/2008 | Solinsky et al. |
| 2008/0309586 | A1 | 12/2008 | Vitale |
| 2008/0317474 | A1 | 12/2008 | Wang et al. |
| 2009/0052023 | A1 | 2/2009 | Winker et al. |
| 2009/0181729 | A1 | 7/2009 | Griffin, Jr. et al. |
| 2010/0027943 | A1 | 2/2010 | Armani et al. |
| 2010/0149073 | A1 | 6/2010 | Chaum et al. |
| 2010/0225673 | A1 | 9/2010 | Miller et al. |
| 2010/0266245 | A1 | 10/2010 | Sabo |
| 2010/0308999 | A1 | 12/2010 | Chornenky |
| 2010/0328420 | A1 | 12/2010 | Roman |
| 2011/0030264 | A1 | 2/2011 | Davidson et al. |
| 2011/0041377 | A1 | 2/2011 | Thomas et al. |
| 2011/0067288 | A1 | 3/2011 | Hakansson et al. |
| 2011/0145981 | A1 | 6/2011 | Teetzel |
| 2011/0187563 | A1 | 8/2011 | Sanders-Reed |
| 2011/0213664 | A1 | 9/2011 | Osterhout et al. |
| 2011/0214082 | A1 | 9/2011 | Osterhout et al. |
| 2011/0239354 | A1 | 10/2011 | Celona et al. |
| 2012/0030985 | A1 | 2/2012 | Mauricio et al. |
| 2012/0033195 | A1 | 2/2012 | Tai |
| 2012/0097741 | A1 | 4/2012 | Karcher |
| 2012/0159833 | A1 | 6/2012 | Hakanson et al. |
| 2012/0182417 | A1 | 7/2012 | Everett |
| 2012/0182610 | A1 | 7/2012 | O'Hara et al. |
| 2012/0192476 | A1 | 8/2012 | Compton et al. |
| 2012/0212414 | A1 | 8/2012 | Osterhout et al. |
| 2012/0238208 | A1 | 9/2012 | Bienas et al. |
| 2012/0255213 | A1 | 10/2012 | Panos |
| 2012/0311910 | A1 | 12/2012 | Mironichev et al. |
| 2012/0317706 | A1 | 12/2012 | Lebel et al. |
| 2012/0320340 | A1 | 12/2012 | Coleman, III |
| 2012/0327247 | A1 | 12/2012 | Mironichev et al. |
| 2013/0016215 | A1 | 1/2013 | Bitar et al. |
| 2013/0033746 | A1 | 2/2013 | Brumfield |
| 2013/0036646 | A1 | 2/2013 | Rubac et al. |
| 2013/0072120 | A1 | 3/2013 | Wu |
| 2013/0088604 | A1 | 4/2013 | Hamrelius et al. |
| 2013/0167425 | A1 | 7/2013 | Crispin |
| 2013/0188943 | A1 | 7/2013 | Wu |
| 2013/0215395 | A1 | 8/2013 | Li |
| 2013/0256104 | A1* | 10/2013 | Fujita ..... H01H 1/36 200/252 |
| 2014/0007485 | A1 | 1/2014 | Castejon, Sr. |
| 2014/0104449 | A1 | 4/2014 | Masarik et al. |
| 2014/0260748 | A1 | 9/2014 | Traver |
| 2014/0285882 | A1 | 9/2014 | Gotz et al. |
| 2015/0016817 | A1 | 1/2015 | Hara et al. |
| 2015/0101234 | A1 | 4/2015 | Priest et al. |
| 2015/0226613 | A1 | 8/2015 | Bauer et al. |
| 2015/0282549 | A1 | 10/2015 | Lebel et al. |
| 2015/0316351 | A1 | 11/2015 | Choiniere |
| 2015/0375865 | A1 | 12/2015 | Fischer et al. |
| 2016/0033234 | A1 | 2/2016 | Swift et al. |
| 2016/0327365 | A1 | 11/2016 | Collin et al. |
| 2017/0010073 | A1 | 1/2017 | Downing |
| 2017/0078022 | A1 | 3/2017 | Masarik et al. |
| 2017/0153713 | A1 | 6/2017 | Niinuma et al. |
| 2017/0237919 | A1 | 8/2017 | Lamesch |
| 2017/0302386 | A1 | 10/2017 | Masarik |
| 2018/0106568 | A1 | 4/2018 | Hedeen et al. |
| 2018/0232952 | A1 | 8/2018 | Hiranandani et al. |
| 2018/0246135 | A1 | 8/2018 | Pan et al. |
| 2018/0302576 | A1 | 10/2018 | Masarik et al. |
| 2019/0094981 | A1 | 3/2019 | Bradski et al. |
| 2019/0166174 | A1 | 5/2019 | Moseman |
| 2019/0222771 | A1 | 7/2019 | Hedeen et al. |
| 2019/0353461 | A1 | 11/2019 | Neal et al. |
| 2019/0353462 | A1 | 11/2019 | Neal |
| 2020/0014887 | A1 | 1/2020 | Moseman et al. |
| 2020/0051481 | A1 | 2/2020 | Masarik et al. |
| 2020/0053303 | A1 | 2/2020 | Vaklev et al. |
| 2020/0081242 | A1 | 3/2020 | Kuczek et al. |

FOREIGN PATENT DOCUMENTS

| | | |
|---|---|---|
| CN | 204944509 | 1/2016 |
| CN | 106612141 | 5/2017 |
| EP | 0 176 169 | 4/1986 |
| EP | 2 722 632 | 4/2014 |
| EP | 2 812 749 | 12/2014 |
| EP | 3 172 524 | 5/2017 |
| EP | 3 205 974 | 8/2017 |
| EP | 3 239 754 | 11/2017 |
| GB | 2162654 | 2/1986 |
| JP | H07-295682 | 11/1995 |
| WO | WO 2005/121688 | 12/2005 |
| WO | WO 2013/080058 | 6/2013 |
| WO | WO 2013/102869 | 7/2013 |
| WO | WO 2013/119983 | 8/2013 |
| WO | WO 2014/062725 | 4/2014 |
| WO | WO 2014/150076 | 9/2014 |
| WO | WO 2016/014655 | 1/2016 |
| WO | WO 2019/222422 | 11/2019 |
| WO | WO 2019/222426 | 11/2019 |
| WO | WO 2020/051464 | 3/2020 |

OTHER PUBLICATIONS

Ackerman, S., "It Only Took the Army 16 Years and 2 Wars to Deploy this Network", Wired.com, Jun. 28, 2012, in 7 pages. URL: http://www.wired.com/dangerrom/2012/06/army-data-network-war/all/.

Armstrong, S. C., "Project Manager Soldier Weapons Program Overview NDIA", May 15, 2012, in 38 pages.

Schott—Glass Made of Ideas, GBPS-MC-GOF-Demo, dated Jan. 2006, pp. S.1-S.8, in 8 pages.

(56) References Cited

OTHER PUBLICATIONS

Sklarek, W., "High Data Rate Capabilities of Multicore Glass Optical Fiber Cables, 22 FGT 'Otische Polymerfasern'", dated Oct. 25, 2006, in 19 pages. URL: http://www.pofac.de/downloads/itgfg/fgt2.2/FGT2.2_Munchen_Sklarek_GOF-Buendel.

Tao, R. et al., "10 Gb/s CMOS Limiting Amplifier for Optical links", Proceedings of the 29th European Solid-State Circuits Conference, Sep. 16-18, 2013, pp. 285-287, Estoril, Portugal, in 3 pages.

Zhu, Z. et al., "AR-Weapon: Live Augmented Reality Based First-Person Shooting System", 2015 IEEE Winter Conference on Applications of Computer Vision, Feb. 2015, in 8 pages.

* cited by examiner

HERMETICALLY SEALED OVER-MOLDED BUTTON ASSEMBLY

BACKGROUND OF THE INVENTION

1. Field of the Invention

The subject invention is directed to a button assembly, and more particularly, to a hermetically sealed over molded button assembly for activating an electronic switch of a communication device.

2. Description of Related Art

It is known in the art to use an adhesive to bond a rubber button to the plastic housing of a communication device for activating an electronic switch within the housing. Overtime, the edges of the rubber button can peel away from the plastic housing, leaving the electronic switch susceptible to the environment. Adhesive bonding is also a time consuming manufacturing technique. Accordingly, there is a need in the art for a more durable, externally sealed interface between a rubber button and a plastic housing that does not require adhesive bonding or any other type of fastener.

The subject invention overcomes the above-noted deficiencies of the prior art button assemblies by providing a rubber button that is over-molded on a plastic cover, which is then ultrasonically or laser welded to a plastic housing. This assembly process eliminates the need for adhesives and creates a durable seal from the environment by compressing the rubber button between the plastic cover and housing. The welding process provides a further improvement over the time consuming adhesive bonding process used in the prior art, because the button assembly of the subject invention is sealed immediately after the welding process is performed, rather than having to wait for the adhesive to bond.

SUMMARY OF THE DISCLOSURE

The subject invention is directed to a new and useful button assembly for actuating an electronic switch, and more particularly, to a hermetically sealed over-molded button assembly for activating an electronic switch associated with a data communication system. The button assembly of the subject invention includes a plastic cover and an elastomeric button that is over-molded on the plastic cover, and then the plastic cover is mechanically attached a plastic housing, so that the rubber button is compressed between the cover and the housing, creating a robust structural seal between the button and the housing.

The plastic housing includes a wall having an exterior surface and an interior surface. The wall of the housing has an aperture extending therethrough from the exterior surface to the interior surface, and a raised ridge is formed on the exterior surface of the wall surrounding the aperture. The cover includes an upper body portion and a lower flange portion. The upper body portion has a top wall and an interior cavity. A port is formed in the top wall of the upper body portion of the cover.

The button includes an upper actuation portion and a lower body portion. The upper actuation portion of the button extends through the port formed in the top wall of the cover. The lower body portion of the button resides within the interior cavity of the upper body portion of the cover. The lower body portion of the button has an outer wall with a bottom surface having a channel for accommodating the raised ridge surrounding the aperture in the housing. The outer wall of the button includes a downwardly extending sealing lip for engaging an interior surface of the aperture formed in the wall of the housing. The outer wall of the button surrounds an interior actuation chamber and an actuation post extends downwardly from the actuation portion of the button within the interior actuation chamber for contacting a switch located below the interior surface of wall of the housing when the actuation portion of the button is depressed.

The subject invention is also directed to a button assembly that includes a plastic cover and an elastomeric button over-molded on the plastic cover. The plastic cover includes an upper body portion having a top wall and an interior cavity. A port is formed in the top wall of the upper body portion and the lower flange portion is adapted and configured to be welded to a wall of a plastic housing. The elastomeric button includes an upper actuation portion and a lower body portion. The upper actuation portion extends through the port formed in the top wall of the upper body portion of the cover, and the lower body portion resides in the interior cavity of the upper body portion of the cover.

Preferably, the lower body portion of the button includes an outer wall having a bottom surface with a channel for accommodating a raised ridge surrounding an aperture formed in the wall of the housing and a downwardly extending sealing lip for engaging an interior surface of the aperture. Preferably, the outer wall of the lower body portion of the button surrounds an interior actuation chamber and an actuation post extends downwardly from the actuation portion of the button within the interior actuation chamber for contacting a switch located below an interior surface of the wall of the housing when the actuation portion of the button is depressed.

The subject invention is also directed to a method of constructing a button assembly, which includes the steps of providing a plastic cover, providing or otherwise overmolding an elastomeric button on the plastic cover, and mechanically attaching the plastic cover to a plastic housing by ultrasonic or laser welding.

These and other features of the hermetically sealed overmolded button assembly of the subject invention will become more readily apparent to those having ordinary skill in the art to which the subject invention appertains from the detailed description of the preferred embodiments taken in conjunction with the following brief description of the drawings.

BRIEF DESCRIPTION OF THE DRAWINGS

So that those having ordinary skill in the art will readily understand how to make and use the hermetically sealed over-molded button assembly of the subject invention without undue experimentation, preferred embodiments thereof will be described in detail herein below with reference to the figures wherein.

DETAILED DESCRIPTION OF THE PREFERRED EMBODIMENTS

Figure 1:
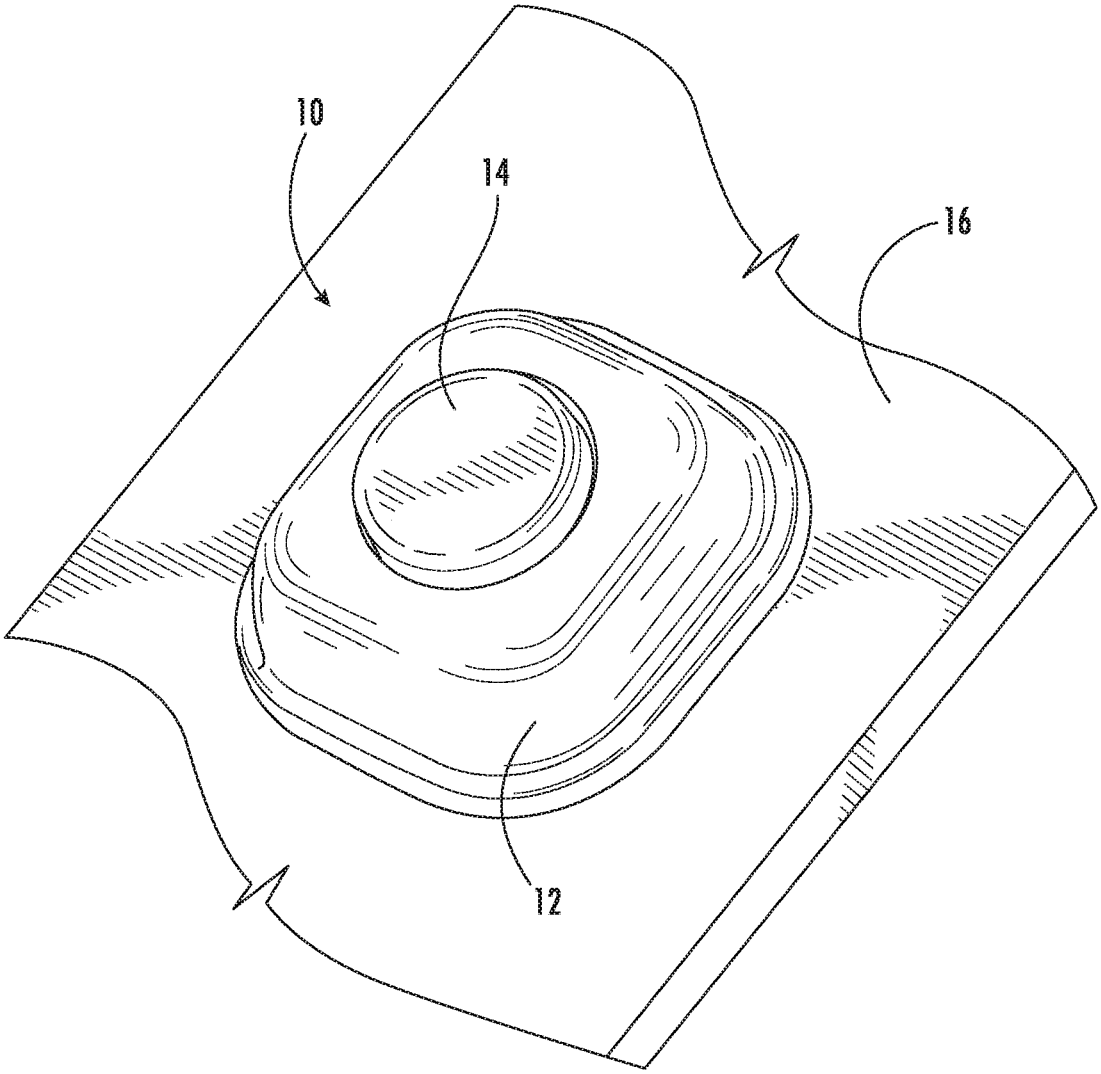
FIG. 1 is a perspective view of the hermetically sealed over-molded button assembly of the subject invention.
Figure 2:
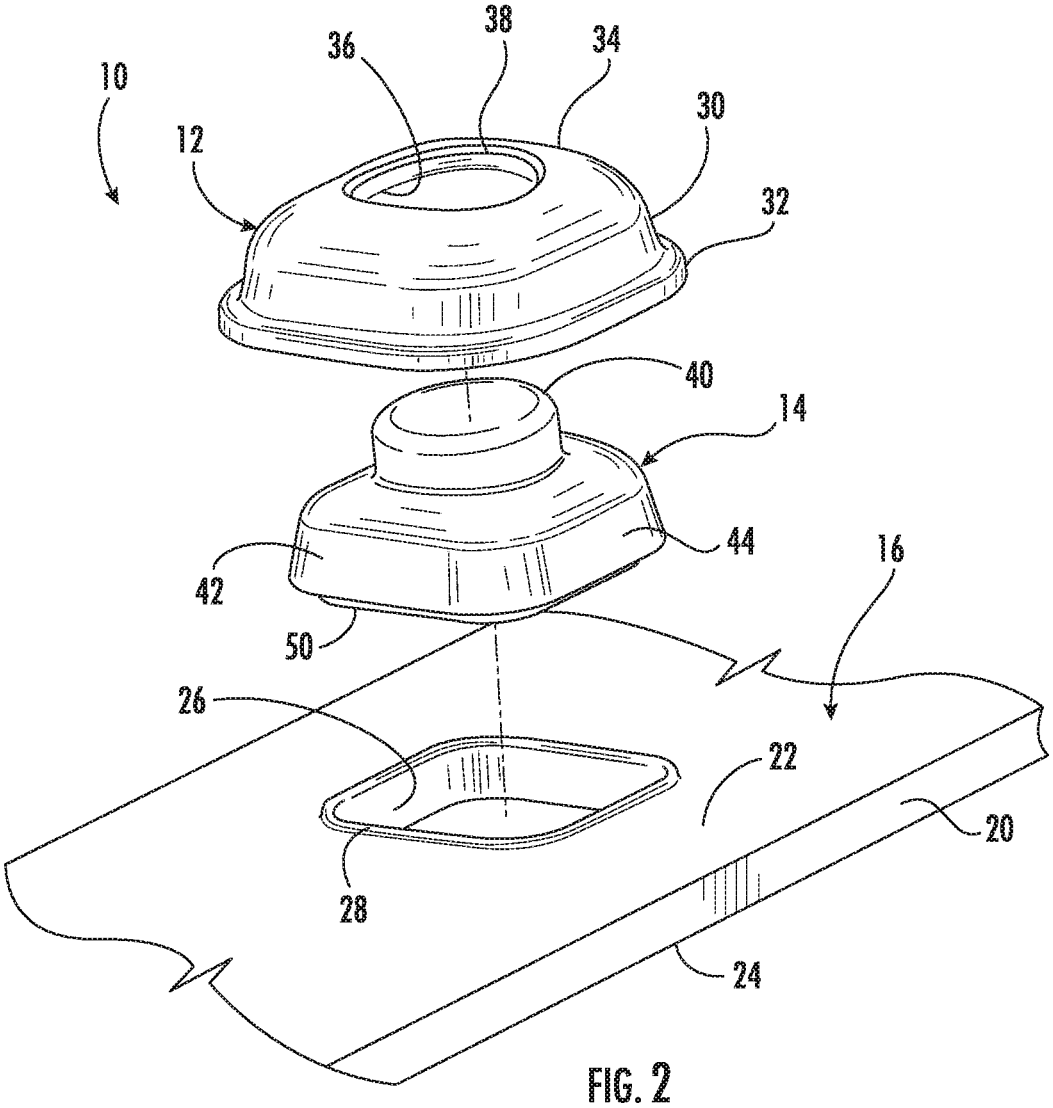
FIG. 2 is an exploded perspective view of the button assembly of FIG. 1, with parts separate for ease of illustration.
Figure 4:
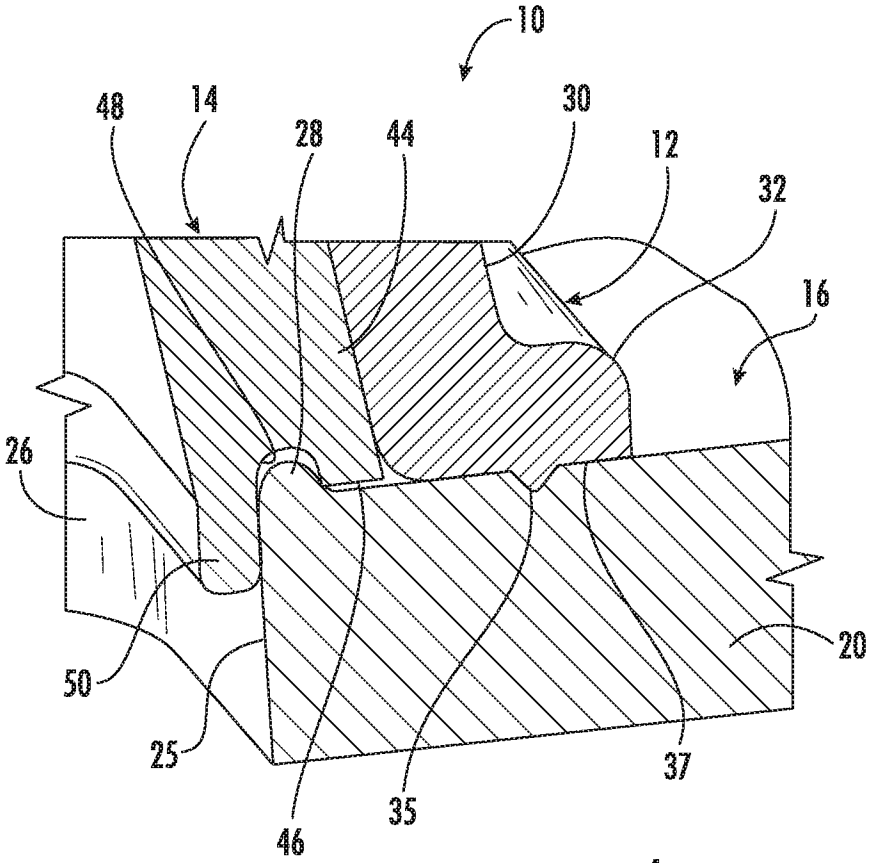
FIG. 4 is an enlarged localized cross-sectional view from FIG. 3.
Figure 3:
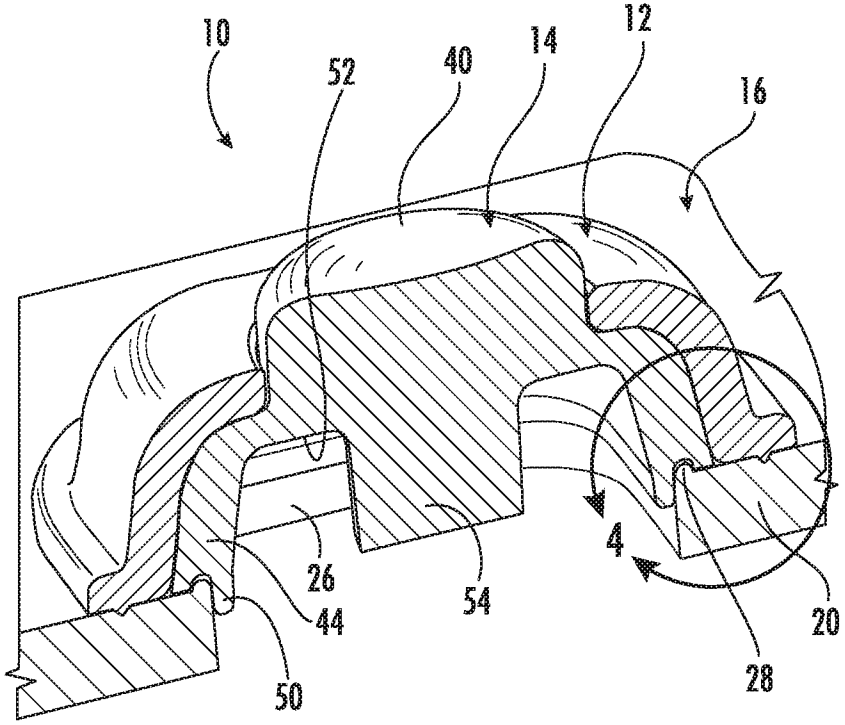
FIG. 3 is a cross-sectional view of the button assembly of the subject invention taken along line 3-3 of FIG. 1.

Referring now to the drawings wherein like reference numerals identify similar structural elements or features of the subject invention, there is illustrated in FIG. 1 a new and useful button assembly for actuating an electronic switch, and more particularly, to a hermetically sealed over-molded button assembly for activating an electronic switch associated with a communication device such as, for example a thermally enhanced night vision goggle system, as disclosed in commonly assigned U.S. Pat. No. 9,705,605, the disclosure of which is herein incorporated by reference The button assembly 10 of the subject invention includes a thermoplastic cover 12 and an elastomeric or rubber button 14 that is over-molded on the thermoplastic cover 12 (i.e., the substrate). The thermoplastic cover 12 is then mechanically attached to a thermoplastic housing 16 by ultrasonic or laser welding. As a result of this joining process, the rubber button 14 is advantageously compressed between the cover 12 and the housing 16. This creates a robust structural seal between the rubber button 14 and the plastic housing 16. Moreover, a durable, externally sealed interface is formed between the rubber button 14 and the plastic housing 16 that protects electronic components in the housing from the environment and does not require adhesive bonding.

The plastic housing 16 includes an outer wall 20 having an exterior surface 22 and an interior surface 24. The wall 20 of the plastic housing 16 has an aperture 26 that extends through the wall 20 from the exterior surface 22 thereof to the interior surface 24 thereof. A raised ridge 28 is formed on the exterior surface 22 of the wall 20 surrounding the periphery of the aperture 26.

The thermoplastic cover 12 of the button assembly 10 includes an upper body portion 30 and a lower flange portion 32. The upper body portion 30 of the cover 12 has a top wall 34 and an interior cavity 36. A circular port or aperture 38 is formed in the top wall 32 of the upper body portion 30 of the cover 12. Integral weldment assistance structure 35 is provided on a contacting surface 37 of the lower flange portion 32, for interacting with the exterior surface 22 of the plastic housing 16 during fabrication.

The rubber button 14 of the button assembly 10 includes an upper actuation portion 40 and a lower body portion 42. The upper actuation portion 40 of the rubber button 14 extends through the port 38 formed in the top wall 32 of the plastic cover 12. The lower body portion 42 of the button 14 resides within the interior cavity 36 of the upper body portion 30 of the cover 12. The lower body portion 42 of the button 14 has an outer wall 44 with a bottom surface 46 having a channel 48 for accommodating and compressing the raised ridge 28 surrounding the aperture 26 in the housing 16.

The outer wall 44 of the button 14 includes a downwardly extending radially inner sealing lip 50 for engaging an interior surface 25 of the aperture 26 formed in the wall 20 of the housing 16. This interface hermetically seals the aperture 26 from the environment, protecting electronic components located within the housing 16.

The outer wall 44 of the button 14 surrounds an interior actuation chamber 52 and an actuation post 54 extends downwardly from the upper actuation portion 40 of the button 14 within the interior actuation chamber 52 for contacting a switch located on a PCB below the interior surface 24 of wall 20 of the housing 16, when the upper actuation portion 40 of the button 14 is depressed.

In sum, the subject invention describes a method of constructing a button assembly 10, which includes the steps of providing a thermoplastic cover 12 (the substrate), over-molding an thermoplastic elastomer (TPE) button 14 on the thermoplastic cover 12, and mechanically attaching the thermoplastic cover 12 to a thermoplastic housing 16 by ultrasonic or laser welding.

While the subject disclosure has been shown and described with reference to preferred embodiments, those skilled in the art will readily appreciate that changes and/or modifications may be made thereto without departing from the scope of the subject disclosure.

For example, while the over-molded button assembly 10 of the subject invention has been discussed in association with a communication system, those skilled in the art will readily appreciate that the over-molded button assembly 10 can be utilized with any type of electronic device that has a thermoplastic housing.

In addition, while the over-molded button assembly 10 and the aperture 26 provided in the housing 16 are shown and described as having a generally rectangular or square configuration, the button assembly and the aperture could be configured in virtually any shape, such as, for example, circular, oblong or oval, as dictated by design.

What is claimed is:

1. A button assembly comprising: a plastic cover; an elastomeric button over-molded on the plastic cover; and a plastic housing, wherein the plastic housing includes a wall having an exterior surface and an interior surface, and wherein the wall has an aperture extending therethrough from the exterior surface to the interior surface; and wherein a raised ridge is formed on the exterior surface of the wall surrounding the aperture;

wherein the plastic cover is mechanically attached to the plastic housing, the elastomeric button disposed at least partially between the plastic cover and the plastic housing;

wherein the button includes an upper actuation portion and a lower body portion, wherein the lower body portion of the button has an outer wall with a bottom surface having a channel for accommodating the raised ridge surrounding the aperture in the housing.

2. A button assembly as recited in claim 1, wherein the plastic cover is mechanically attached to the plastic housing by ultrasonic or laser welding.

3. A button assembly as recited in claim 1, wherein the cover includes an upper body portion and a lower flange portion, the upper body portion having a top wall and an interior cavity.

4. A button assembly as recited in claim 3, wherein a port is formed in the top wall of the upper body portion of the cover.

5. A button assembly as recited in claim 4, wherein the upper actuation portion of the button extends through the port formed in the top wall of the cover.

6. A button assembly as recited in claim 5, wherein the lower body portion of the button resides within the interior cavity of the upper body portion of the cover.

7. A button assembly as recited in claim 6, wherein the outer wall of the button includes a downwardly extending sealing lip for engaging an interior surface of the aperture formed in the wall of the housing.

8. A button assembly as recited in claim 7, wherein the outer wall of the button surrounds an interior actuation chamber and an actuation post extends downwardly from the actuation portion of the button within the interior actuation chamber for contacting an electronic switch located below the interior surf ace of wall of the housing when the actuation portion of the button is depressed.

9. A button assembly comprising:

a) a plastic cover including an upper body portion and a lower flange portion, the upper body, portion of the cover having a top wall and an interior cavity, wherein a port is formed in the top wall of the upper body portion and the lower flange portion is adapted and configured to be welded to an exterior wall of a plastic housing; and b) elastomeric button over-molded on the plastic cover and including an upper actuation portion and a lower body portion, wherein the upper actuation portion extends through the port formed in the top wall of the upper body portion of the cover, and the lower body portion resides in the interior cavity of the upper body portion of the cover; wherein the lower body, portion of the button includes an outer wall having a bottom surface with a channel for accommodating a raised ridge surrounding an aperture formed in the wall of the housing and a downwardly extending sealing lip for engaging an interior surface of the aperture.

10. A button assembly as recited in claim 9, wherein the outer wall of the lower body portion of the button surrounds an interior actuation chamber and an actuation post extends downwardly from the actuation portion of the button within the interior actuation chamber for contacting an electronic switch located below an interior surface of the wall of the housing when the actuation portion of the button is depressed.

* * * * *